US006368689B1

(12) United States Patent
Connor Sledge et al.

(10) Patent No.: US 6,368,689 B1
(45) Date of Patent: Apr. 9, 2002

(54) PERFORATED CENTERFLOW ROLLED PRODUCT

(75) Inventors: Linda A. Connor Sledge, Atlanta, GA (US); Tammy L. Baum, Neenah; John R. Hanson, Appleton, both of WI (US); Donald E. Waldroup, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/349,308

(22) Filed: Jul. 8, 1999

(51) Int. Cl.[7] ..... B32B 3/10
(52) U.S. Cl. ..... 428/43
(58) Field of Search ..... 428/43, 906

(56) References Cited

U.S. PATENT DOCUMENTS

| | | | | |
|---|---|---|---|---|
| 3,716,132 | A | 2/1973 | Lewyckyj | |
| 3,835,754 | A | 9/1974 | Lewyckyj | |
| 4,627,117 | A | 12/1986 | Morishita | |
| 4,737,393 | A | 4/1988 | Linkous | |
| 4,963,406 | A | 10/1990 | Gooding, Jr. et al. | |
| 4,982,845 | A | 1/1991 | Prascak et al. | |
| 5,041,317 | A | 8/1991 | Greyvenstein | |
| 5,114,771 | A | 5/1992 | Ogg et al. | |
| 5,198,276 | A | 3/1993 | Nakajima | |
| 5,496,605 | A | 3/1996 | Augst et al. | |
| 5,560,514 | A | 10/1996 | Frazier | |
| 5,562,964 | A | 10/1996 | Jones | |
| 5,616,387 | A | 4/1997 | Augst et al. | |
| 5,704,566 | A | 1/1998 | Schutz et al. | |
| 6,228,454 | B1 * | 5/2001 | Johnson et al. | 428/43 |

FOREIGN PATENT DOCUMENTS

| | | |
|---|---|---|
| DE | 8715128.6 | 1/1988 |
| EP | 0341739 A2 | 11/1989 |
| GB | 484034 | 4/1938 |

OTHER PUBLICATIONS

PCT Search Report, Oct. 11, 2000.

* cited by examiner

*Primary Examiner*—Alexander S. Thomas
(74) *Attorney, Agent, or Firm*—Dority & Manning

(57) ABSTRACT

A rolled web of centerflow material, such as paper or non-woven material includes perforation lines separating the material into individual wipes or sheets. Each perforation line comprises a varying perforation profile defined by opposite edge portions and a middle portion having generally the same bond strengths, and intermediate portions between the edge and middle portions having a different bond strength. This perforation profile is effective in reducing dispensing defects, and particularly streaming/roping defects. Alternatively, the perforation line may have stronger edge portions adjacent at lest one weaker middle portion.

15 Claims, 3 Drawing Sheets

Blade 70
strong/weak/strong

Blade 71
strong/weak/strong

Blade 72
weak/strong/weak

Blade 73
weak/strong/weak

PERFORATED CENTERFLOW ROLLED PRODUCT

BACKGROUND OF THE INVENTION

The present invention relates to centerflow rolled products such as webs of paper or non-woven material, and particularly to a centerflow rolled web wherein individual sheets or wipes are defined by an improved perforation line.

Centerflow rolled products are known in the art. Such products are typically coreless and dispensed by an end sheet or wipe being pulled from the center of the rolled product through a dispenser. The rolled web of material is conventionally defined into individual sheets or wipes by transverse perforation lines that define a tear line for each sheet or wipe. The perforation lines comprise alternating bonds and perforations which, in most conventional products, are of uniform length and spacing. The perforations are typically rectangular slits having a transverse orientation.

Perforating devices for defining perforation lines in any manner of rolled paper or non-woven products are also well known in the art. For example, conventional perforating devices are incorporated into almost all bathroom tissue and towel liners in a typical manufacturing and converting plant. These devices comprise a perforator roll, which holds a number of perforation (perf) blades, and a stationary anvil head which holds a number of anvil assemblies. The anvil assemblies are typically positioned helically on the stationary anvil head so as to keep all of the perf blades from striking all of the anvils at the same time. In the process, a balance must be struck between having the perforation lines with sufficient bond strength to operate efficiently without breaks on the converting equipment, and yet have a low enough bond strength to provide easy and undamaged sheet detaching for the consumer. Poor detaching has always been a major consumer issue for rolled products, and particularly for centerflow products.

Centerflow products are typically dispensed through a dispenser that incorporates a narrow opening or passage through which the end of the centerflow web is pulled. Thus, the material is bunched or gathered as it is pulled through the dispenser, and the individual wipes or sheets are pulled apart with the material in this bunched condition. Thus, the dynamics of the separating or tearing process along the perforation line defined on a centerflow product is fundamentally different from that of conventional bath tissue or paper towels wherein the product is unwound from the circumference of the roll and is typically in a flat or straight state upon being separated by the consumer. One conventional centerflow product dispenser is known in the art as the WetTask® system by Kimberly-Clark of Neenah, Wis. The WetTask® dispensing system is also described in U.S. Pat. No. 5,560,514, the entire disclosure of which is incorporated herein by reference for all purposes.

Advances have been made in the art of perforated roll products to improve the perforation line profiles. For example, U.S. Pat. No. 5,562,964 to Kimberly-Clark Corporation discloses that sheet detaching can be significantly improved by customizing the perf blades so that the perforation lines in the sheet have a lower bond length, and thus lower bond strength, at or near the outer edges of the sheet as compared to the rest of the sheet. This is accomplished according to the '964 patent by using perf blades that provide different levels of bonding strength in the appropriate areas of the perfed sheet. The '964 patent describes that the number of poor detachments between individual sheets decreases as the bonded lengths at the outer edges of the towel sheets are shortened. The teaching, however, according to the '964 patent is not particularly relevant to centerflow products.

A need thus exists in the art for a perforation line profile particularly suited for the dynamics of dispensing centerflow rolled products so as to decrease the number of separation defects.

OBJECTS AND SUMMARY OF THE INVENTION

Objects and advantages of the invention will be set forth in part in the following description, or may be obvious from the description, or may be learned through practice of the invention.

According to the present invention, an improved rolled web of centerflow material, such as a paper or non-woven material, is provided wherein the material is dispensed by an end sheet or wipe being pulled from a center of the rolled web. The web is divided into individual wipes or sheets by transversely extending perforation lines. Each perforation line further comprises a varying perforation profile defined by opposite edge portions and a middle section between the edge portions. In one desired embodiment, the edge portions comprise a stronger overall bond strength as compared to at least one portion of the middle section.

The edge portions have a "stronger bond strength" as compared to the middle portion in that the length of the perfs along the perforation line in the edge portions is substantially less than the length of the perfs in the weaker middle portion. The bonds may have the same length in both the edge and middle portions. For example, the perforations in the edge portions may have a length generally between about 30% to about 70% of the perforations in the middle portion, and in one desired embodiment about 45% to about 50%. In one particularly desired embodiment, the bonds have a length of about 0.032 inches along the entire perforation line, the perfs in the middle portion have a length of about 0.433 inches, and the perfs in the edge portions have a length of about 0.208 inches.

In one variation of the stronger edge embodiment of the invention, the middle section may comprise at least two weaker bonded middle portions separated by a stronger bonded middle portion such that the weaker bonded middle portions are disposed directly adjacent to the edge portions. The stronger bonded middle portion may comprise the same bond/perf profile as the edge portions. In this embodiment, the edge portions and the stronger bonded middle portion may have a length generally about twice as long as that of the weaker bonded middle portions.

As described in greater detail below, applicants have found that the perforation line profile as described above wherein the edge portions have a stronger bond strength than at least one weaker middle portion is particularly efficient in reducing overall perforation defects with centerflow rolled products.

In an alternative embodiment of the invention, the perforation line is defined by opposite edge portions and a middle portion having generally the same bond strengths. An intermediate portion is disposed between each of the edge portions and middle portion, with the intermediate portion having a different bond strength than the edge and middle portions. The edge and middle portions may have a length generally about twice as long as that of the intermediate portions.

In an example of this embodiment particularly useful for reducing total perforation defects, the edge portions and the middle portion have a stronger bond strength as compared to the intermediate portions.

In an example of this embodiment particularly useful in reducing roping/streaming defects, the edge portions and middle portion have a weaker bond strength as compared to the intermediate portions.

The length of the edge portions, middle portion, and intermediate portions will depend on the profile of the individual perforation blades, as well as the blade pattern across the entire perforation line. For example, as explained in greater detail below, a perforation blade particularly useful with the present invention has a length of 4.5 inches and is divided into three distinct perforation sections. The blade may have a weak/strong/weak profile wherein the length of the perfs in the strong section is less than the length of the perfs in the edge sections. Alternatively, the blade may have a strong/weak/strong profile wherein the length of the perfs in the weak middle section is significantly longer than the length of the perfs in the stronger edge sections.

The perforation blades are aligned end to end and, for example, four such blades would define an 18 inch perforation line. A typical 12 inch web of material would then be positioned along the perforation line to obtain the desired perforation profile across the web. For example, if four strong/weak/strong profile blades are aligned end to end, and the web of material positioned relative to the blades so as to define stronger edge portions along the perforation line, the stronger edge portions are defined by adjacent strong sections of adjoining perforation blades. The edge portions thus have an overall length twice as great as the intermediate weak middle portions that are directly adjacent to the edge portions. Thus, the perforation lines defined with the perforation blades described herein will have an alternating perforation profile. The profile may comprise strong edge portions and a strong middle portion with weaker intermediate middle portions defined between the strong edge portions and strong middle portion. Alternatively, the profile may comprise weak edge portions and a weak middle portion with strong intermediate middle portions defined between the weak edge and middle portions. Each profile has certain beneficial aspects, as described in greater detail below.

DETAILED DESCRIPTION

Figure 1:
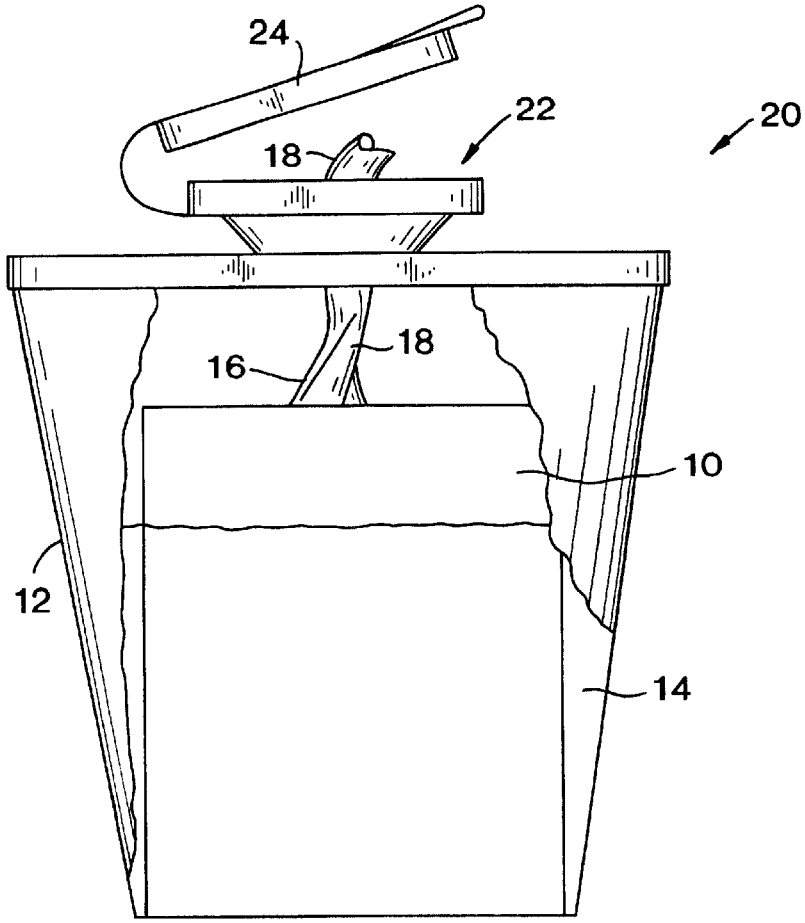
FIG. 1 is a side elevational view of the centerflow rolled product dispenser as described in U.S. Pat. No. 5,560,514.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield a still further embodiment. It is intended that the present application include such modifications and variations as come within the scope of the appended claims and their equivalents.

The present invention is particularly useful with centerflow rolled products. FIG. 1 illustrates a conventional dispenser 20 for a rolled centerflow product 10. Dispenser 20 is illustrated and described in greater detail in U.S. Pat. No. 5,560,514, the entire disclosure of which is incorporated herein by reference for all purposes. Briefly, dispenser 20 includes a housing 12 in which a centerflow rolled product 10 is contained. A liquid 14 may also be provided in housing 12 to saturate the individual wipes or sheets of the rolled product. Rolled product 10 is formed by a continuous strip of web material 16, as is commonly understood in the art. A lead end 18 of the web material 16 extends through a dispensing nozzle 22 of dispenser 20. A lid 24 is provided to close the dispensing orifice in nozzle 22. As particularly seen in FIG. 1, the end 18 of the web material is pulled through the dispenser in the form of a bunched or gathered strip, the consumer will grab the end of the strip extending out of nozzle 22 and then yank or jerk the individual sheet of material so as to tear or separate the sheet along provided perforation lines, as is commonly understood in the art.

Figure 2:
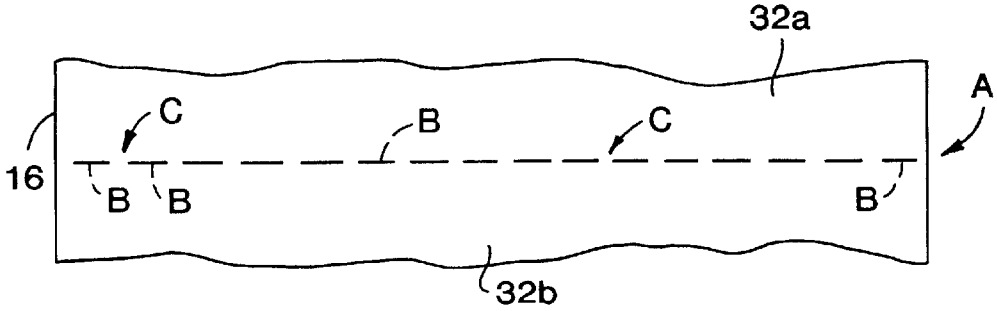
FIG. 2 is a diagrammatic view of a conventional perforation line defined between two adjacent sheets of web material.

FIG. 2 illustrates a conventional perforation line A defining two sheets of web material 32*a*, 32*b*. This conventional perforation line A is formed by alternating perforations B and bonds C. The length of the perforations B will determine the overall bond strength along the perforation line. In conventional centerflow products, the bonds may have a length of about 0.030 inches to 0.040 inches and the perforations may have a length of about 0.3125 inches to about 0.375 inches. These dimensions are not, however, limitations of the present invention. The bond length and perforation lengths are typically uniform across the perforation line, as indicated in FIG. 2.

Figure 3:
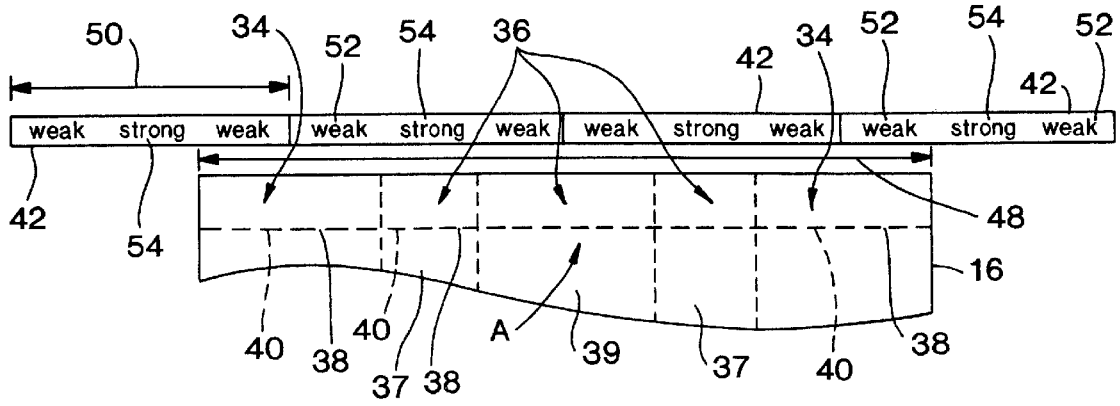
FIG. 3 is a diagrammatic view particularly illustrating the relationship between an array of perforation blades having a weak/strong/weak profile and a perforation line formed thereby.
Figure 4:
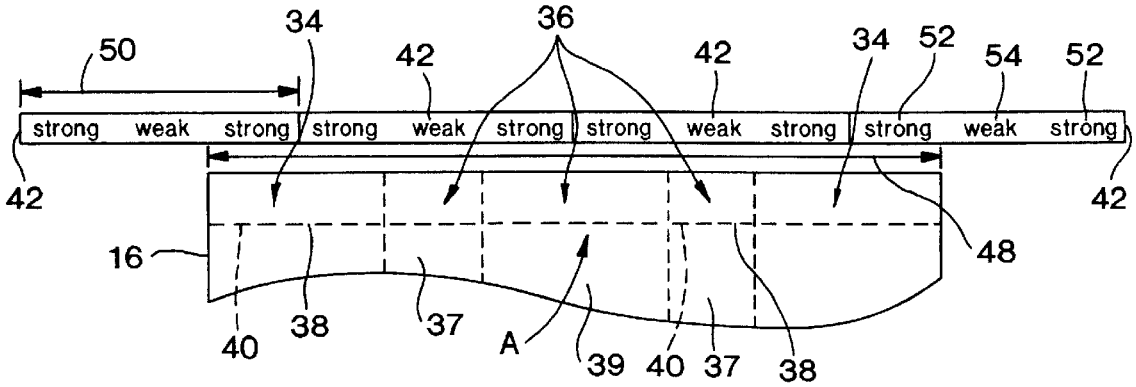
FIG. 4 is a partial diagrammatic view of another array of perforation blades having a strong/weak/strong profile and the perforation line defined thereby.

FIGS. 3 and 4 illustrate perforation lines A according to the invention defined transversely across web material 16. Perforation lines A separate the web material into individual sheets or webs. Referring to FIGS. 3 and 4, the perforation lines A comprise a varying perforation profile that includes opposite edge portions 34 and at least one middle portion 36 having a different bond strength than that of edge portions 34. Referring to FIG. 3, the edge portions 34 are relatively "weak" portions in that the length of perforations 40 is significantly greater than the length of perforations 40 in immediately adjacent "strong" middle or intermediate portions. The middle portions 36 may include an alternating perforation profile as well. For example, referring again to FIG. 3, the middle portions 36 are defined by strong intermediate portions 37 on each side of a center weak portion 39. Due to the profile of the perforation blades 42 used to define the perforation line, edge portions 34 and center portion 39 have a length about twice as long as that of the intermediate portions 37.

FIG. 4 is similar to FIG. 3 except that the perforation profile is essentially reversed. Perforation line A in FIG. 4 is also divided into edge portions 34 and middle portions 36. The middle portions 36 include a center portion 39 and intermediate portions 37. The edge portions 34 and center portion 39 are "strong" portions compared to intermediate portions 37. The length of perforations 40 in the edge 34 and center portion 39 is significantly less than the length of perforations 40 in the weaker intermediate sections. The length of the bonds 38 is uniform across the length of perforation line A.

Referring particularly to FIG. 4, it should be appreciated that middle portions 36 may comprise the same profile between edge portions 34. In other words, all of the middle portions may have the same "weak" profile as provided in intermediate portions 37. This embodiment would obviously require a different perforation profile on the respective perforation blades. However, this embodiment of stronger edge portions with a single weaker middle portion defined therebetween is within the scope and spirit of the invention.

In the embodiments of the invention illustrated in FIGS. 3 and 4, the length of the perforations in the stronger portions along the perforation line is generally between about 45% to about 50% of the perforation lengths in the weaker portions. This percentage range is merely one suitable range and is not a limitation of the invention.

FIGS. 3 and 4 also illustrate embodiments of perforation blades 42 having a varying perforation profile. Referring to FIG. 3, each blade 42 has a length 50. With conventional blades, length 50 is 4.5 inches. Each blade 42 has a varying weak/strong/weak profile wherein edge sections 52 are weak sections and middle section 54 is a strong section. As discussed above with regards to perforation lines A, the sections are "weak" or "strong" according to the length of the perforations. In the embodiments illustrated, the sections 52, 54 are 1.5 inches in length. To define perforation line A illustrated in FIG. 3, it can be seen that four perforation blades 42 are aligned end to end. In this manner, the weak edge sections 52 are adjoining. Sheet material 16 has an overall length 48 and is centered on the perforation blades. For example, sheet material 16 may have an overall length 48 of about 12 inches and would be centered as indicated in FIG. 3 relative to blades 42. Thus, in this arrangement, edge portions 34 of perforation line A would be about three inches in length and be defined by adjacent weak sections 52 of separate blades. Likewise, center portion 39 would also be defined by adjacent weak sections 52 of blades 42. Intermediate sections 37 would be defined by strong sections 54 of individual blades and be half as long as the adjacent portions on either side thereof.

FIG. 4 illustrates the opposite profile. Edge portions 34 of perforation line A are defined by adjacent strong sections 52 of blades 42. Likewise, center portion 39 is defined by adjacent strong sections 52 of blades 42. Intermediate portions 37 are defined by weak intermediate sections 54.

It should be appreciated that the profile of perforation line A may be varied according to changes in the perforation profile of blades 42. For example, referring to FIG. 4 in particular, all of the middle portions 36 may be defined by weak blade segments if the blade profile was changed accordingly. This embodiment is within the scope and spirit of the invention so long as at least one weak middle portion (intermediate portions 37) are disposed adjacent to each of the edge portions 34.

Although the present description has focused on the perforations as essentially rectangular slits, it should be appreciated that the perforations can take on other patterns or configurations that may be used to create the "weaker" bonding strengths, such as slits, holes, inclined slits, chevrons, or any combination of patterns or configurations. Similarly, it is not a requirement of the invention that the bonds have a uniform length across the perforation line.

Figure 5A:
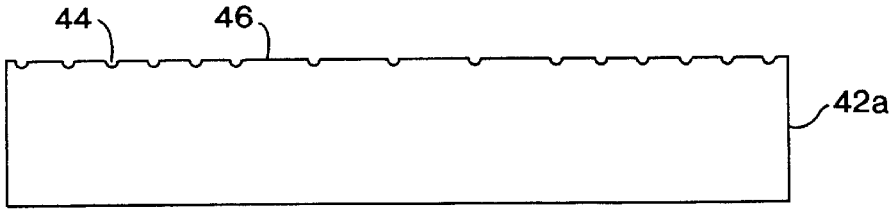
FIGS. 5*a* through 5*d* are actual shadow views of perforation blades according to the invention particularly showing the bond areas and perforation blade segments.
Figure 5B:
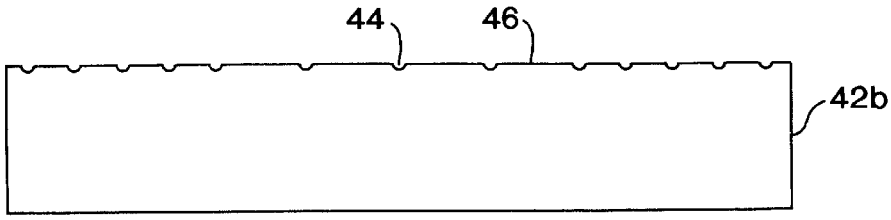
Figure 5C:
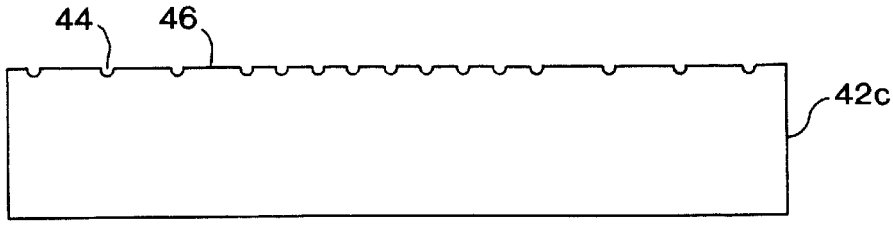
Figure 5D:
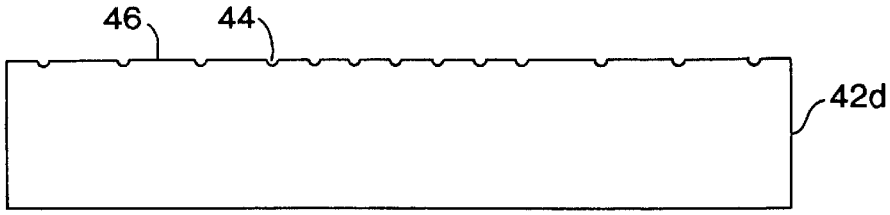

FIGS. 5*a* through 5*d* are cross-sectional "shadow" views of actual embodiments of perforation blades according to the invention. It should be noted that the notches and blade segments appear non-uniform in these figures due only to the manner in which the profiles were made. This non-uniform appearance should not be taken as a limitation of the invention. FIG. 5*a* is a blade 42*a* identified as blade 70 having a strong/weak/strong profile. Notches 44 are indicated along the top edge of blade 42*a*. The notches essentially define the bond lengths. Perforation blade segments 46 intermediate of bonds 44 define the length of the perforations. Blade 42*b* identified as blade 71 illustrates another strong/weak/strong profile. The difference between blades 70 and 71 is in the length of the perforations, as discussed in greater detail below. FIG. 5*c* illustrates a blade 42*c* identified as blade 72 having a weak/strong/weak profile. Likewise, FIG. 5*d* illustrates a blade 42*d* having another weak/strong/weak profile. Perforation blades 42 according to FIGS. 5*a* through 5*d* were used to create and test improved centerflow rolled products according to the invention.

TESTING AND EXAMPLES

Centerflow rolled webs of material were perforated with different arrays of perforation blades according to FIGS. 5*a* through 5*d* and tested as follows:

A roll of Hydroknit® material having a width of 12 inches was disposed in a 1.2 gallon dispenser. The dispenser was a WetTask® dispenser having a tri-lobal dispensing disk, as described in U.S. Pat. No. 5,560,514. Water was added to the dispenser in order to saturate the web material. Hydroknit® is a 2.6 osy (88 gsm) hydroentangled pulp and polypropylene spunbond material (2.0 osy pulp/0.6 osy polypropylene spunbond). The "control" product was perforated with one of two types of conventional perforation blades. The conventional blades were chosen depending on the material stiffness of the Hydroknits material and had a profile of 0.030 inch bonds and 0.3125 inch perforations or 0.040 inch bonds and 0.375 inch perforations. The differences between the control blades was not significant to the tests. The perforations and bonds alternated uniformly across the width of the perforation line.

The perforation blades (including the test and control blades) all had the same common characteristics:

Blade thickness: 0.040 inches

Blade height: 0.875 inches

Blade length: 4.500 inches

Notch depth: 0.050 inches

Four test blades were produced. Blades 70 and 72 (FIGS. 5*a* and 5*c*) had a weak/strong/weak profile. Blades 73 and 71 (FIGS. 5*d* and 5*b*) had a strong/weak/strong profile. Table 1 below identifies the characteristics for the control and test blades:

TABLE 1

| BLADE | PROFILE | (1) 0.030 in. BOND (2) 0.040 in. BOND WEAK SECTION | | 0.3125 in. PERF 0.375 in. PERF STRONG SECTION | |
|---|---|---|---|---|---|
| CONTROL | CONSTANT | BOND | PERF | BOND | PERF |
| BLADE 70 | WEAK/STRONG/WEAK<br>TOTAL MIDDLE SECTION: 1.44 in.<br>TOTAL EDGE SECTIONS: 3.06 in. | 0.032 in.<br>% BONDED: | 0.405 in.<br>7.32 | 0.032 in.<br>% BONDED: | 0.208 in.<br>13.33 |
| BLADE 72 | WEAK/STRONG/WEAK<br>TOTAL MIDDLE SECTION: 1.68 in.<br>TOTAL EDGE SECTIONS: 2.82 in. | 0.032 in.<br>% BONDED: | 0.371 in.<br>7.94 | 0.032 in.<br>% BONDED: | 0.178 in.<br>15.26 |
| BLADE 73 | STRONG/WEAK/STRONG<br>TOTAL MIDDLE SECTION: 2.11 in.<br>TOTAL EDGE SECTIONS: 2.39 in. | 0.032 in.<br>% BONDED: | 0.494 in.<br>6.08 | 0.032 in.<br>% BONDED: | 0.234 in.<br>12.03 |
| BLADE 71 | STRONG/WEAK/STRONG<br>TOTAL MIDDLE SECTION: 1.83 in.<br>TOTAL EDGE SECTIONS: 2.67 in. | 0.032 in.<br>% BONDED: | 0.433 in.<br>7.00 | 0.032 in.<br>% BONDED: | 0.208 in.<br>13.17 |

From Table 1, it can be seen that the percentage of bonded web of the weaker sections is from about 50% to about 55% of that for the stronger sections.

The Hydroknit® centerflow web was perforated with the blades identified in Table 1 according to the blade alignment illustrated in FIGS. 3 and 4 respectively. The rolled products were then tested for perforation defects as follows:

The dispensing pail was placed on a lab bench and the tester instructed to withdraw and tear the individual wipes in succession with one hand while holding the neck of the dispenser with the other. The angle of pull was maintained at about 45 degrees and the direction of pull was to the right. The acceleration of the pull was determined and adhered to as closely as possible by use of a metronome. Ninety percent of the pulls were at a constant uniform speed and ten percent of the pulls were done in a jerking motion. Six cycles (rolls) were conducted for each blade profile. A first cycle was conducted at a uniform pull acceleration with the metronome at 58 beats/min. Cycles two, three, and four were conducted at a uniform acceleration of 80 beats/min. Cycle five was conducted at a uniform acceleration of 104 beats/min. Cycle six was conducted at a jerking acceleration of 104 beats/min. The individual wipes were dispensed and defects recorded. Following dispensing of each roll, the number of wipes dispensed were counted and recorded.

As used herein, dispensing defects included any one of the following:

Tear—A rip in the wiper that occurs at a different location in the wiper other than where it is grasped.

Perf tear—A small rip in the wiper that occurs only at the perforation point.

Short tail—The end of the wiper does not extend sufficiently above the dispenser to grasp and pull.

Streaming/roping—When several connected wipers come out of the dispenser with one pull (roping max is one arms length of wipers).

Lost wiper—When no wiper is available to grasp. The end of the wiper is below the dispensing orifice.

Excessive tail—When more tail is left above the dispensing orifice than can be closed up in the dispensing funnel.

Complete wiper attached to tail (CWAT)—After one wiper is dispensed, a complete additional wiper is pulled and remains attached to the tail of another wiper that remains within the dispenser.

Bunching—One or more wipers becomes packed tightly against the dispensing orifice and the tester is not able to dispense the next wiper.

Table 2 below provides the results of the testing for total defects for the perforation lines in the web material defined by blades 70 through 73, as well as the control blade.

TABLE 2

| PRODUCT SAMPLE | SHEET COUNT | DEFECTS | NON-DEFECTIVE | % DEFECTIVE |
|---|---|---|---|---|
| CONTROL | 371 | 132 | 239 | 35.6 |
| BLADE 70 | 445 | 147 | 298 | 33.0 |
| BLADE 72 | 447 | 136 | 311 | 30.4 |
| BLADE 73 | 430 | 130 | 300 | 30.2 |
| BLADE 71 | 439 | 109 | 330 | 24.8 |

For total defects, the control product had the highest percentage of defects. The product sample from blade 71 had a statistically different percentage of total defects (24.8%) as compared to the control product (35.6%). Product samples from blades 70, 72, and 73 did not produce a statistically different percentage difference in total defects. Thus, the perforation line profile having strong edge portions, weak intermediate portions directly adjacent to the strong edge portions, and a strong central portion proved efficient in significantly reducing total perforation defects. Applicants believe that the strong central portion does not contribute significantly to the beneficial results and may be substituted with a weak portion so that all of the middle portions are essentially weak portions.

Table 3 below provides the results of streaming/roping defects for the product samples from the same test, as well as the control sample.

TABLE 3

| PRODUCT SAMPLE | SHEET COUNT | DEFECTS | NON-DEFECTIVE | % DEFECTIVE |
|---|---|---|---|---|
| CONTROL | 371 | 87 | 284 | 23.5 |
| BLADE 70 | 445 | 44 | 401 | 9.9 |
| BLADE 72 | 447 | 32 | 415 | 7.2 |
| BLADE 73 | 430 | 11 | 419 | 2.6 |
| BLADE 71 | 439 | 30 | 409 | 6.8 |

It can be seen that the control product had a significantly greater percentage of streaming/roping defects (23.5%) as compared to the product samples made from any of the blades 70 through 73. Accordingly, it can be seen that, for at least reducing streaming/roping defects, either of the perforation line profiles illustrated in FIGS. 3 and 4 are useful. This is significant since the streaming/roping defect is a primary concern in dispensing of centerflow rolled products.

It should be appreciated by those skilled in the art that various modifications and variations can be made in the present invention without departing from the scope and spirit of the invention. It is intended that the present invention include such modifications and variations as come within the scope and spirit of the appended claims and their equivalents.

What is claimed is:

1. A rolled web of centerflow paper or nonwoven material comprising a lead dispensing end extending generally transversely from a center of said rolled web wherein said material is dispensed by pulling said lead dispensing end from a center of said rolled web, said rolled web comprising a plurality of spaced apart transverse perforation lines that define individual sheets of said rolled material, each said perforation line further comprising a varying perforation profile defined by opposite edge portions and at least one middle portion adjacent each said edge portion, wherein said edge portions comprise a stronger bond strength as compared to said respective adjacent middle portion.

2. The rolled web as in claim 1, comprising at least two said weaker bonded middle portions wherein a said weaker bonded middle portion is disposed directly adjacent each said edge portion.

3. The rolled web as in claim 2, further comprising a stronger bonded middle portion defined between said weaker bonded middle portions, said stronger bonded middle portion having perforation lengths generally equal to those in said edge portions.

4. A rolled web of centerflow paper or nonwoven material comprising a lead dispensing end extending generally transversely from a center of said rolled web wherein said material is dispensed by pulling said lead dispensing end from a center of said rolled web, said rolled web comprising a plurality of spaced apart transverse perforation lines that define individual sheets of said rolled material, each said perforation line further comprising a varying perforation profile defined by opposite edge portions and at least one middle portion adjacent each said edge portion, wherein said edge portions comprise a stronger bond strength as compared to said respective adjacent middle portion; and wherein said perforation lines comprise alternating bonds and perforations, said bonds having a generally equal length across said perforation line, and said perforations having a shorter length in said edge portions.

5. The rolled web as in claim 4, wherein said perforations in said edge portions have a length generally between 45% to 55% of said perforations in said middle portion.

6. The rolled web as in claim 5, wherein said bonds have a length of about 0.032 inches, said perforations in said middle portion have a length of about 0.433 inches, and said perforations in said edge portions have a length of about 0.208 inches.

7. A rolled web of centerflow paper or nonwoven material wherein said material is dispensed by being pulled from a center of said rolled web, said rolled web comprising a plurality of spaced apart transverse perforation lines that define individual sheets of said rolled material, each said perforation line further comprising a varying perforation profile defined by opposite edge portions and at least two middle portions wherein one of said middle portions is disposed directly adjacent each said edge portion, said edge portions comprising a stronger bond strength as compared to said respective adjacent middle portion, and further comprising a stronger bonded middle portion defined between said weaker bonded middle portions, said stronger bonded middle portion having perforation lengths generally equal to those in said edge portions, and wherein said edge portions and said stronger bonded middle portion have a length generally twice as long as that of said weaker bonded middle portion.

8. A rolled web of centerflow paper or nonwoven material comprising a lead dispensing end extending generally transversely from a center of said rolled web wherein said material is dispensed by pulling said lead dispensing end from a center of said rolled web, said rolled web comprising a plurality of spaced apart transverse perforation lines that define individual sheets of said rolled material, each said perforation line further comprising a varying perforation profile defined by opposite edge portions and a middle portion having generally the same bond strength, and an intermediate portion between each said edge portion and said middle portion having a different bond strength than said edge portions and middle portion.

9. The rolled web as in claim 8, wherein said edge portions and said middle portion have a stronger bond strength as compared to said intermediate portions.

10. The rolled web as in claim 8, wherein said edge portions and said middle portion have a weaker bond strength as compared to said intermediate portions.

11. A rolled web of centerflow paper or nonwoven material wherein said material is dispensed by being pulled from a center of said rolled web, said rolled web comprising a plurality of spaced apart transverse perforation lines that define individual sheets of said rolled material, each said perforation line further comprising a varying perforation profile defined by opposite edge portions and a middle portion having generally the same bond strength, and an intermediate portion between each said edge portion and said middle portion having a different bond strength than said edge portions and said middle portion, and wherein said edge portions and said middle portion have a length generally twice as long as that of said intermediate portions.

12. A rolled web of centerflow paper or nonwoven material comprising a lead dispensing end extending generally transversely from a center of said rolled web wherein said material is dispensed by pulling said lead dispensing end from a center of said rolled web, said rolled web comprising a plurality of spaced apart transverse perforation lines that define individual sheets of said rolled material, each said perforation line further comprising a varying perforation profile defined by opposite edge portions and a middle portion having generally the same bond strength, and an intermediate portion between each said edge portion and said middle portion, said edge portions and said middle portion having a stronger bond strength as compared to said intermediate portions, and wherein said perforation lines comprise alternating bonds and perforations, said bonds having a generally equal length across said perforation line, and said perforations having a shorter length in said edge portions and said middle portion.

13. The rolled web as in claim 12, wherein said perforations in said edge portions and said middle portion have a length generally between about 45% to about 55% of said perforations in said intermediate portion.

14. The rolled web as in claim 12, wherein said perforations in said intermediate portions have a length generally between about 45% to about 55% of said perforations in said edge portions and said middle portion.

15. A rolled web of centerflow paper or no oven material wherein said material is dispensed by being pulled from a center of said rolled web, said rolled web comprising a plurality of spaced apart transverse perforation lines that define individual sheets of said rolled material, each said perforation line further comprising a varying perforation profile defined by opposite edge portions and a middle portion having generally the same bond strength, and an intermediate portion between each said edge portion and said middle portion, said edge portions and said middle portion having a weaker bond strength as compared to said intermediate portion, and wherein said perforation lines comprise alternating bonds and perforations, said bonds having a generally equal length across said perforation line, and said perforations having a longer length in said edge portions and said middle portion.

* * * * *